United States Patent [19]

Garnerone

[11] Patent Number: 4,984,142

[45] Date of Patent: Jan. 8, 1991

[54] OPTICAL INDICATOR

[75] Inventor: Alberto Garnerone, Rosta, Italy

[73] Assignee: Sirena S.p.A., Turin, Italy

[21] Appl. No.: 532,409

[22] Filed: Jun. 4, 1990

[30] Foreign Application Priority Data

Jul. 11, 1989 [IT] Italy ..... 53241/89[U]

[51] Int. Cl.[5] ..... F21V 21/00

[52] U.S. Cl. ..... 362/249; 362/236; 362/252; 362/240

[58] Field of Search ..... 362/227, 235, 236, 249, 362/237, 240, 231, 252, 226, 431, 362, 375

[56] References Cited

U.S. PATENT DOCUMENTS

| | | | |
|---|---|---|---|
| Re. 32,899 | 4/1989 | Laidman | 362/240 |
| 1,723,471 | 8/1929 | Dunham | 362/252 |
| 3,511,982 | 5/1970 | Salter | 362/226 |
| 3,980,878 | 9/1976 | Crompton | 362/375 |
| 4,286,307 | 8/1981 | Harvey et al. | 362/240 |
| 4,344,108 | 8/1982 | Collins et al. | 362/240 |
| 4,562,518 | 12/1985 | Kumagai | 362/249 |
| 4,661,891 | 4/1987 | Kitamura | 362/227 |
| 4,787,018 | 11/1988 | Poyer | 362/431 |
| 4,812,956 | 3/1989 | Chen | 362/236 |
| 4,858,088 | 8/1989 | Agabekov | 362/227 |

*Primary Examiner*—Ira S. Lazarus
*Assistant Examiner*—Y. Quach
*Attorney, Agent, or Firm*—Sughrue, Mion, Zinn, Macpeak & Seas

[57] ABSTRACT

An optical indicator for industrial use comprises an elongate hollow casing with at least two partially transparent longitudinal bands and houses a support structure carrying at least two bulbs in correspondence with the bands and connected to electrical terminals at one end of the support structure. At least one electrical connector is coupled to the said end of the bulb-holder structure and is fixed in a first end of the casing. The bulb-holder structure is mounted in the casing so as to be removable through a second, open end of the casing and a closure member is fixed to the end of the structure opposite the connector. The closure member is adapted to be coupled to the second end of the casing with mutual lateral covering over a predetermined axial length such that, when the bulb-holder structure is removed from the casing, it is disconnected from the connector before the closure member is disconnected from the casing to an extent sufficient to allow access to the interior of the casing.

3 Claims, 3 Drawing Sheets

OPTICAL INDICATOR

Figure 1:
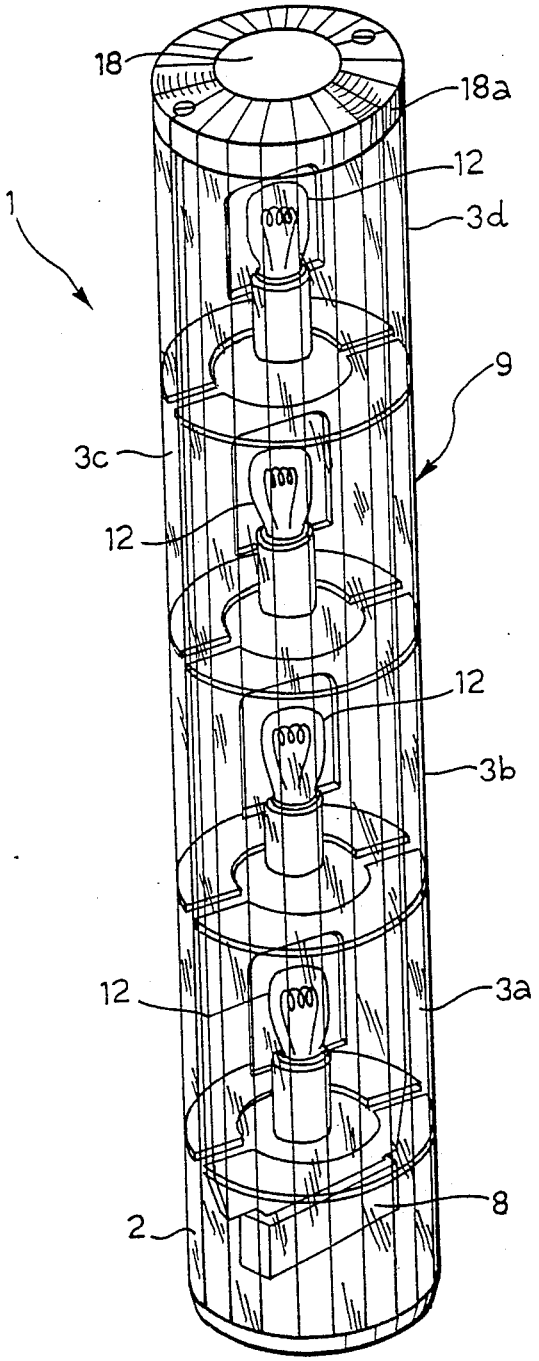

The present invention relates to an optical indicator, particularly for industrial use.

More specifically, the invention relates to an optical indicator comprising an elongate hollow casing which has at least two longitudinal bands or portions that are at least partially transparent, and within which is a support structure carrying at least two bulbs in positions corresponding to the bands of the casing and connected to electrical terminals arranged at one end of the support structure, and at least one electrical connector coupled to the said end of the bulb-holder structure and arranged to allow the bulbs to be connected t operating devices outside the casing.

Optical indicators of this type, with longitudinal bands of different colours, are currently used to indicate the proper operation or breakdown of, for example, automatically operating machines or industrial robots.

In known devices of this type, the bulb-holder structure and associated electrical connector are fixed permanently to a support part in use and the casing is fitted releasably on to and connected to the bulb-holder structure.

Should a bulb fail in these known devices it is necessary to remove the casing to allow access to the bulb-holder structure and to replace the broken or blown bulb. This operation may be carried out with the bulb-holder structure still connected to the voltage supply, with potential danger to the operator and/or the risk of causing unintentional short-circuiting.

The object of the present invention is to provide a safer optical indicator which allows the broken or blown bulb or bulbs to be replaced quickly while avoiding the disadvantages of the prior-art devices explained above.

This object is achieved according to the invention by means of an optical indicator of the type specified above, the main characteristic of which lies in the fact that the casing has a first end intended to be connected firmly to a support part in use, the other (or second) end being open and the electrical connector being fixed in the first end of the casing;

and the bulb-holder structure is mounted in the casing so as to be removable through the second end of the casing, a closure member being fixed to the end of the bulb-holder structure opposite the connector and being adapted to be coupled to the second end of the casing with mutual lateral covering over a predetermined axial length such that, when the bulb-holder structure is removed from the casing, it is disconnected from the electrical connector before the closure member is disconnected from the casing to an extent sufficient to allow access to the interior of the casing.

The indicator according to the invention ensures that, immediately the closure member has been disconnected from the casing, the bulb-holder structure is also disconnected from the electrical connector so that the structure is separated from the voltage supply. The broken or blown bulb or bulbs can thus be replaced without any danger to the operator and without the risk of causing unintentional short-circuiting.

Figure 2:
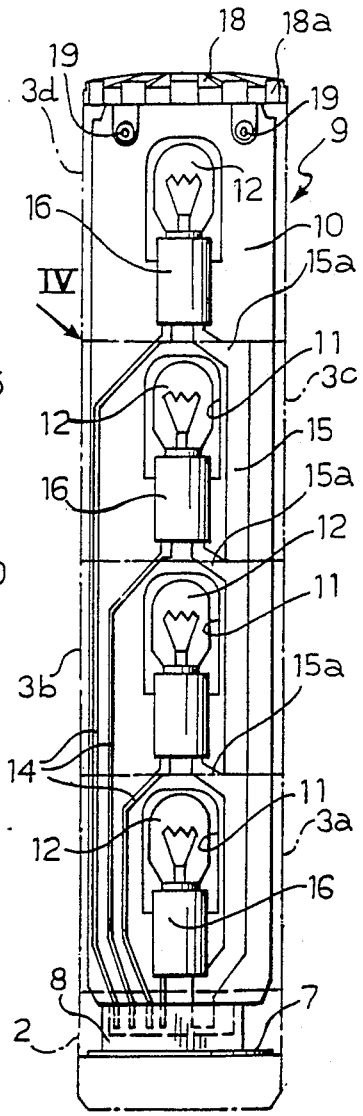
Figure 3:
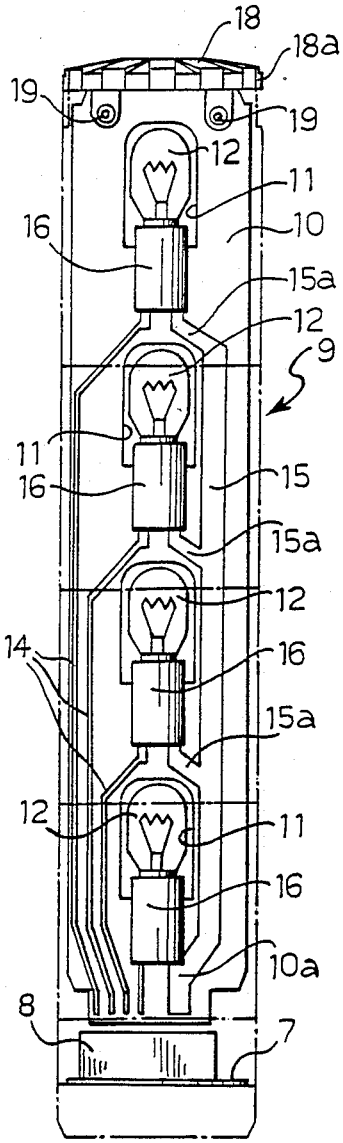
Figure 4:
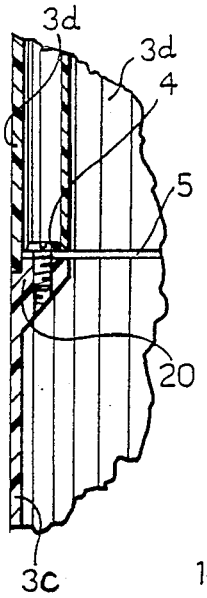
Figure 5:
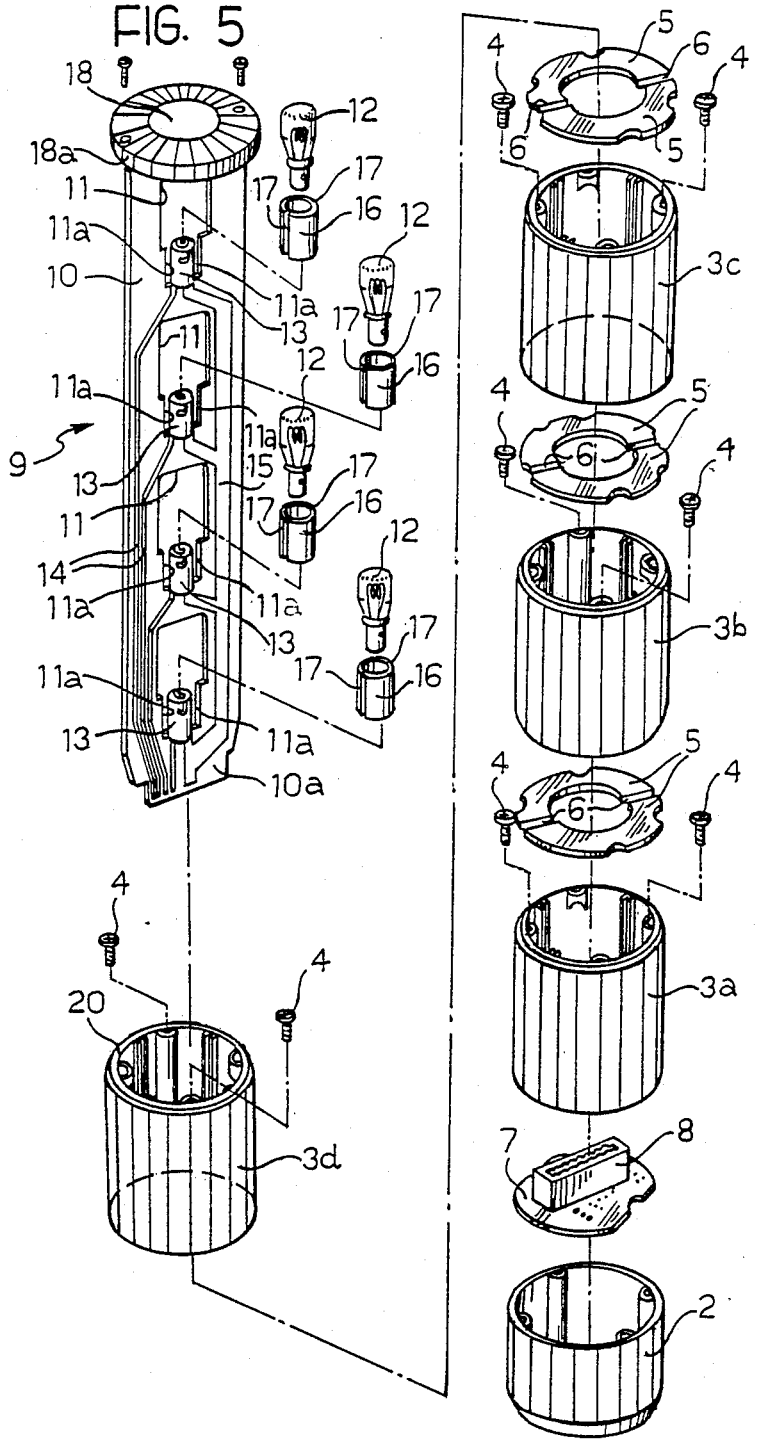

Further characteristics and advantages of the invention will become apparent from the detailed description which follows, given with reference to the appended drawings provided purely by way of non-limiting example, in which:

FIG. 1 is a perspective view of an optical indicator according to the invention, FIG. 2 is a side view of the bulb-holder structure of the indicator according to the invention in the condition in which this structure is coupled to the electrical connector, FIG. 3 is a view similar to that of FIG. 2, showing the bulb-holder structure disconnected from the electrical connector, FIG. 4 is a partially-sectioned view of a detail indicated IV in FIG. 2, showing the manner in which the successive longitudinal sections which form the casing of the indicator are coupled together, and FIG. 5 is an exploded perspective view of the indicator.

With reference to the drawings, an optical indicator according to the invention comprises a substantially-cylindrical hollow casing, generally indicated 1, including an essentially cup-shaped base portion surmounted (in the example illustrated) by four longitudinal tubular portions 3*a*–3*d* of different colours, for example orange, red, green and yellow. The casing 1 thus has a modular structure and may, in general, comprise a different number of longitudinal sections from a minimum of two to any desired maximum.

The individual portions 3*a*–3*d* are connected together by screws 4 with the interposition of pairs of half-rings 5 in the manner which can be discerned from FIGS. 4 and 5. As seen in particular in FIG. 5, two diametrally-opposed guide slots, indicated 6, are defined between the facing ends of a pair of half-rings 5.

The lower longitudinal portion or band 3*a* of the body 1 is similarly connected to the base portion 2 by screws.

Within the base portion of the casing 1 is a printed circuit board 7 carrying a multipolar electrical connector 8 of the slot type on its upper surface. The board 7 may be connected to external circuits for controlling the indicator through apertures formed in the bottom of the base member 2.

The indicator further includes a bulb-holder structure, generally indicated 9 in FIGS. 2, 3 and 5. This structure comprises an elongate printed circuit board or card 10 having a plurality of apertures 11 in each of which is mounted a bulb 12 with its bulb-holder socket 13. As shown in particular in FIG. 5, the bulbs 12 and their sockets 13 are preferably of the bayonet-coupling type.

One face of the board or card 10 has a plurality of conductive supply tracks 14 each of which extends from the lower edge of this board or card almost to the lower edge of an aperture 11 in the board or card.

The board or card 10 also carries a common conductive return track 15 for the various bulbs, extending from the lower edge of the board or card almost to the upper aperture and having branches 15*a* towards each of the apertures in the card.

Each bulb-holder 13 has a pair of terminals or rheophores welded to one end of a track 14 and to a respective branch 15*a* of the conductive track 15.

As seen in FIG. 5, each aperture 11 in the board or card 10 has two, parallel, facing sides or edges 11*a* which are spaced from the associated bulb-holder socket 13.

Each bulb-holder socket 13 has an associated tubular retaining member 16 of electrically-insulating material with an outer diameter greater than the distance between the facing edges 11*a* of the aperture 11 in which the socket is located. Each retaining member 16 has two opposite longitudinal grooves 17 in its exterior (FIG. 5) and is fitted onto the respective socket 13 so that these grooves engage slidably with the facing edges 11*a* of the corresponding aperture 11 in the board 10. Thus, each socket 13 is held firmly in the desired working position.

A cover and closure member 18 is fixed to the upper end of the board or card 10. This member is firmly and permanently fixed to the board 10, for example, by a pair of rivets, indicated 19 in FIGS. 2 and 3.

Each longitudinal portion 3*a*–3*d* has an upper smaller-diameter collar portion (indicated 20 in FIG. 4) which is inserted in the lower end of the overlying portion or band.

The cover and closure member 18 fixed to the board or card 10 has a lateral skirt 18*a* for coupling axially with and for covering the periphery of the top collar portion 20 of the upper band 3*d*.

The bulb-holder structure 9 is inserted releasably in the casing 1 and is guided by the pair of slots 6 defined between the half-rings 5. The card 10 has a tapered portion 10*a* at its lower end (FIGS. 3 and 5) where the conductive tracks 14 and 15 terminate. The tapered portion 10*a* of the board or card 10 is inserted in the connector 8 mounted in the bottom portion 2 of the indicator casing.

Conveniently, the cover 18 and the top collar 20 of the final band or portion 3*d* are formed so that (when the bulb-holder structure 9 is inserted in the casing) the skirt of the closure member 18 and the collar 20 of the end portion of the casing provide lateral covering for each other for a predetermined axial length. In particular, this mutual axial covering length is such that, when the bulb-holder structure 9 is removed from the casing 1, this structure is disconnected from the connector 8 before the cover member 18 is disconnected from the end portion 3*d* of the tubular casing to an extent sufficient to allow access to the interior of the casing.

Maximum safety during replacement of the bulbs is thus ensured.

What I claimed is:

1. An optical indicator, particularly but not exclusively for industrial use, comprising an elongate hollow casing with at least two longitudinal bands which are at least partially transparent, a support structure within the casing, at least two bulbs carried by the support structure in positions corresponding to the bands of the casing, electrical terminals which are arranged at one end of the support structure and to which the bulbs are connected, and at least one electrical connector coupled to the said end of the bulb-holder structure and arranged to allow the bulbs to be connected to circuit-operating devices outside the casing, wherein the elongate hollow casing has a first end which is intended to be connected firmly to a support part in use and in which the connector is fixed, and a second end which is open and the bulb-holder structure is mounted in the elongate hollow casing so as to be removable through the second end thereof, and wherein a closure member is fixed to the end of the structure opposite the connector and is adapted to be coupled to the second end of the casing with mutual lateral covering over a predetermined axial length such that, when the bulb-holder structure is removed from the casing, it is disconnected from the connector before the closure member is disconnected from the elongate hollow casing to an extent sufficient to allow access to the interior of the elongate hollow casing.

2. An indicator according to claim 1, wherein the bulb-holder structure includes a printed circuit board defining at least two apertures and bearing conductive tracks, and a respective bulb-holder socket mounted in each aperture and connected to the conductive tracks on the board.

3. An indicator according to Claim 2, wherein:

each bulb-holder socket has two electrical terminals welded to corresponding pre-arranged conductive areas on the printed circuit board adjacent the aperture in which the socket is located;

each aperture in the plate has two, substantially parallel, facing sides or edges spaced from the associated bulb-holder socket;

each socket has an associated tubular retaining member of insulating material with an outer diameter greater than the distance between the facing edges of the aperture in the board and defining two opposite guide and positioning grooves in its exterior, and the retaining member is mounted around the respective socket with the grooves slidably engaged with the facing edges of the associated aperture in the board.

* * * * *